US008678857B2

(12) United States Patent
Zhang et al.

(10) Patent No.: US 8,678,857 B2
(45) Date of Patent: Mar. 25, 2014

(54) ELECTRICAL CONNECTOR HAVING SHIELDING MEMBER

(75) Inventors: Zhi-Cheng Zhang, Kunshan (CN); John Chow, Saratoga, CA (US)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 115 days.

(21) Appl. No.: 13/349,876

(22) Filed: Jan. 13, 2012

(65) Prior Publication Data

US 2012/0196478 A1 Aug. 2, 2012

(30) Foreign Application Priority Data

Jan. 28, 2011 (CN) ..... 2011 1 0031098

(51) Int. Cl.
*H01R 13/60* (2006.01)

(52) U.S. Cl.
USPC ..... 439/541.5; 439/607.01

(58) Field of Classification Search
USPC ..... 439/541.5, 540.1, 607.01–607.05, 439/607.23, 607.27
See application file for complete search history.

(56) References Cited

U.S. PATENT DOCUMENTS 6,511,348 B1 * 1/2003 Wojtacki et al. ..... 439/620.18
6,520,799 B1 * 2/2003 Cheng et al. ..... 439/541.5
6,540,564 B1 * 4/2003 Ko ..... 439/676
6,655,988 B1 12/2003 Tyco
6,663,437 B2 12/2003 Hai
6,729,906 B1 * 5/2004 Simmons et al. ..... 439/607.26
6,736,673 B1 * 5/2004 Simmons et al. ..... 439/541.5
6,878,012 B2 * 4/2005 Gutierrez et al. ..... 439/607.26
6,945,820 B1 * 9/2005 Blichasz et al. ..... 439/620.05
7,052,315 B2 * 5/2006 Murr et al. ..... 439/540.1
7,077,707 B2 * 7/2006 Hyland et al. ..... 439/676
7,121,898 B2 * 10/2006 Murr et al. ..... 439/676
7,168,985 B1 * 1/2007 Zhang et al. ..... 439/607.23
7,510,441 B2 * 3/2009 Zhang et al. ..... 439/620.18
7,785,135 B2 * 8/2010 Wu ..... 439/490
7,824,219 B2 * 11/2010 Wang ..... 439/607.27
7,828,598 B2 * 11/2010 Wang ..... 439/607.27
8,118,615 B2 * 2/2012 Peng et al. ..... 439/607.27
8,215,982 B2 * 7/2012 Bu et al. ..... 439/490
2007/0042643 A1 * 2/2007 Zhang et al. ..... 439/607
2010/0062626 A1 * 3/2010 Chow et al. ..... 439/79
2010/0062645 A1 * 3/2010 Chow et al. ..... 439/620.22
2011/0306242 A1 * 12/2011 Zhang ..... 439/607.01
2012/0196458 A1 * 8/2012 Zhang et al. ..... 439/95
2012/0196479 A1 * 8/2012 Chow et al. ..... 439/607.35
2013/0017730 A1 * 1/2013 Zhang ..... 439/626

* cited by examiner

*Primary Examiner* — Amy Cohen Johnson
*Assistant Examiner* — Vladimir Imas
(74) *Attorney, Agent, or Firm* — Wei Te Chung; Ming Chieh Chang

(57) ABSTRACT

An electrical connector includes a port (102, 103) for insertion of a mating connector along an insertion direction, a mating module (50) having a set of contacts (540, 542) received in the port, a transferring module (53) located behind the mating module and having a number of conductive components mounted thereon, and a shielding component (51, 52) disposed between the set of contacts and the transferring module. The shielding component is located between the set of contacts and the transferring module. The shielding component is simple and easily assembled to the transferring module.

20 Claims, 17 Drawing Sheets

ELECTRICAL CONNECTOR HAVING SHIELDING MEMBER

BACKGROUND OF THE INVENTION

1. Field of the Invention

The present invention relates to an electrical connector suitable for high-speed communication, and more particularly to an electrical connector having a shielding component.

2. Description of Related Art

U.S. Pat. No. 6,655,988 issued to Simmons et al. on Dec. 2, 2003 discloses an electrical connector comprising a mating module, an upper shielding component, a lower shielding component and a transferring module. The transferring module includes a left PCB, a right PCB, and a vertical ground plate located between the left and right PCBs. The upper shielding component is L-shaped. The lower shielding is Z-shaped. The upper and lower shielding component extend into the transferring module. It is difficult to assemble the shielding component to the vertical ground plate.

Hence, an electrical connector having a simple shielding component is desired.

SUMMARY OF THE INVENTION

Accordingly, an object of the present invention is to provide an electrical connector having a simple shielding component.

In order to achieve the object set forth, the invention provide an electrical connector includes a port for insertion of a mating connector along an insertion direction, a mating module having a set of contacts received in the port, a transferring module located behind the mating module and having a plurality of conductive components mounted thereon, and a shielding component disposed between the set of contacts and the transferring module. The shielding component is located between the set of contacts and the transferring module. The shielding component is simple and easily assembled to the transferring module.

Other objects, advantages and novel features of the invention will become more apparent from the following detailed description when taken in conjunction with the accompanying drawings.

DETAILED DESCRIPTION OF THE PREFERRED EMBODIMENT

Figure 1:
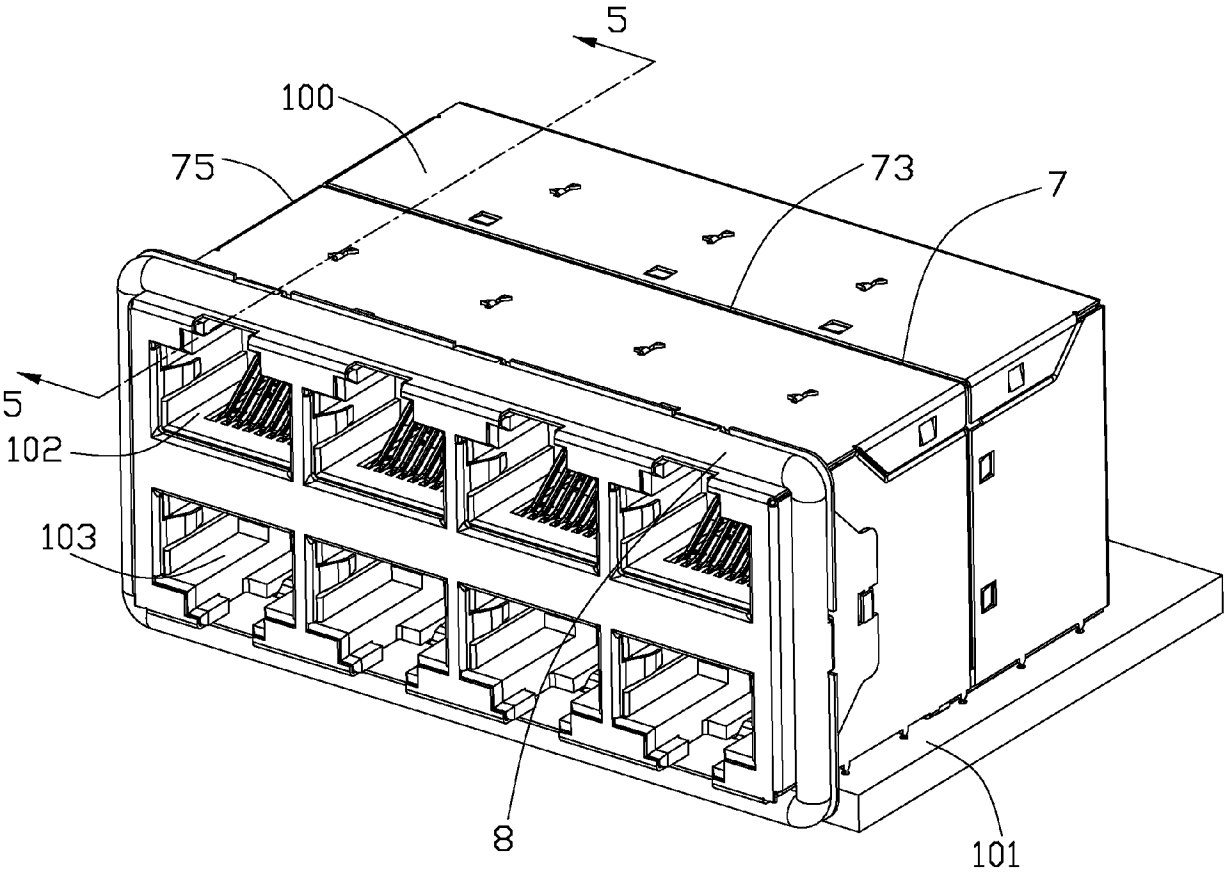
FIG. 1 is a perspective view of a stacked electrical connector according to the present invention, mounted on a horizontal mother printed circuit board (PCB)
Figure 2:
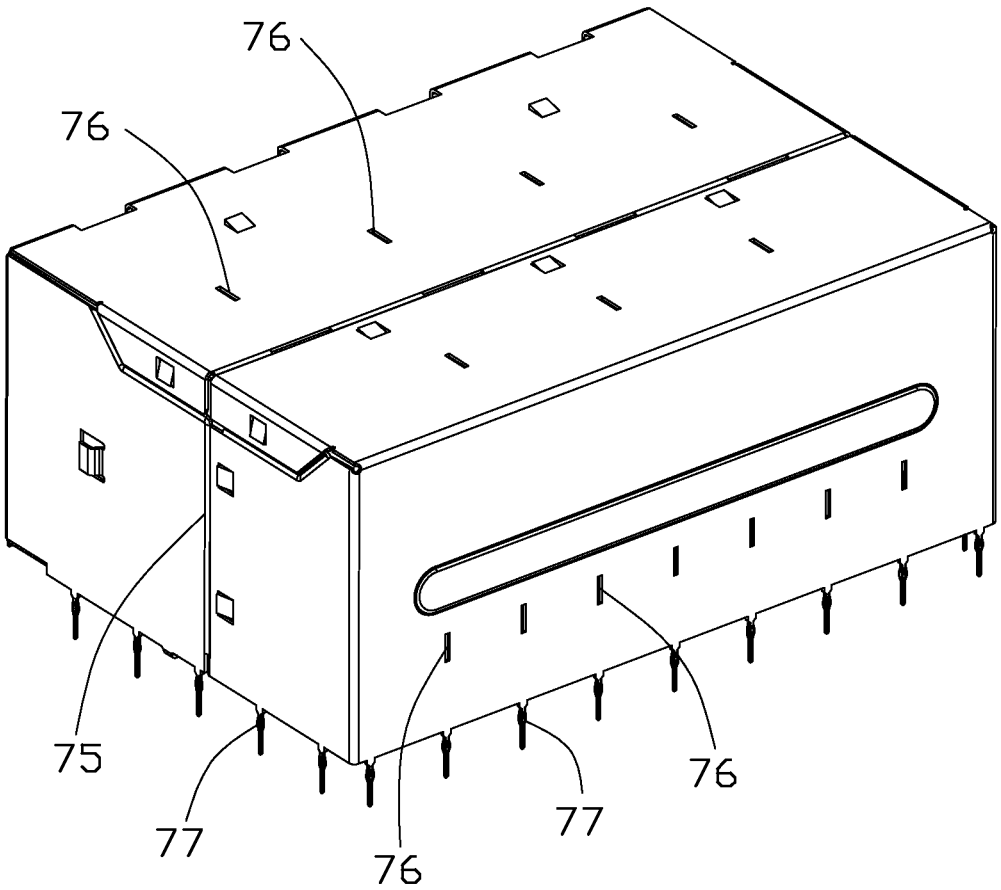
FIG. 2 is a perspective view of a shielding shell of the electrical connector shown in FIG. 1.
Figure 3:
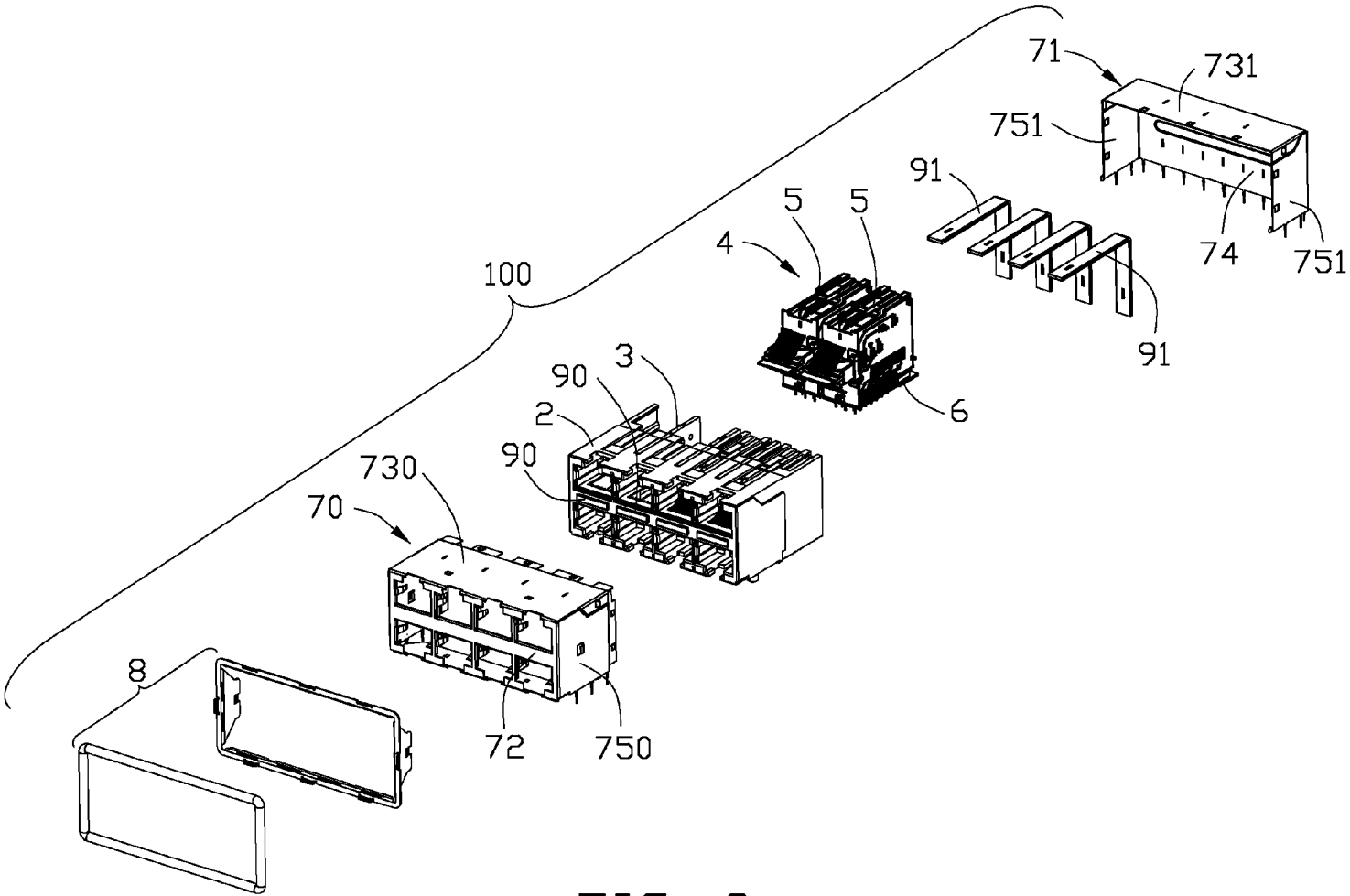
FIG. 3 is an exploded view of the electrical connector shown in FIG. 1.
Figure 4:
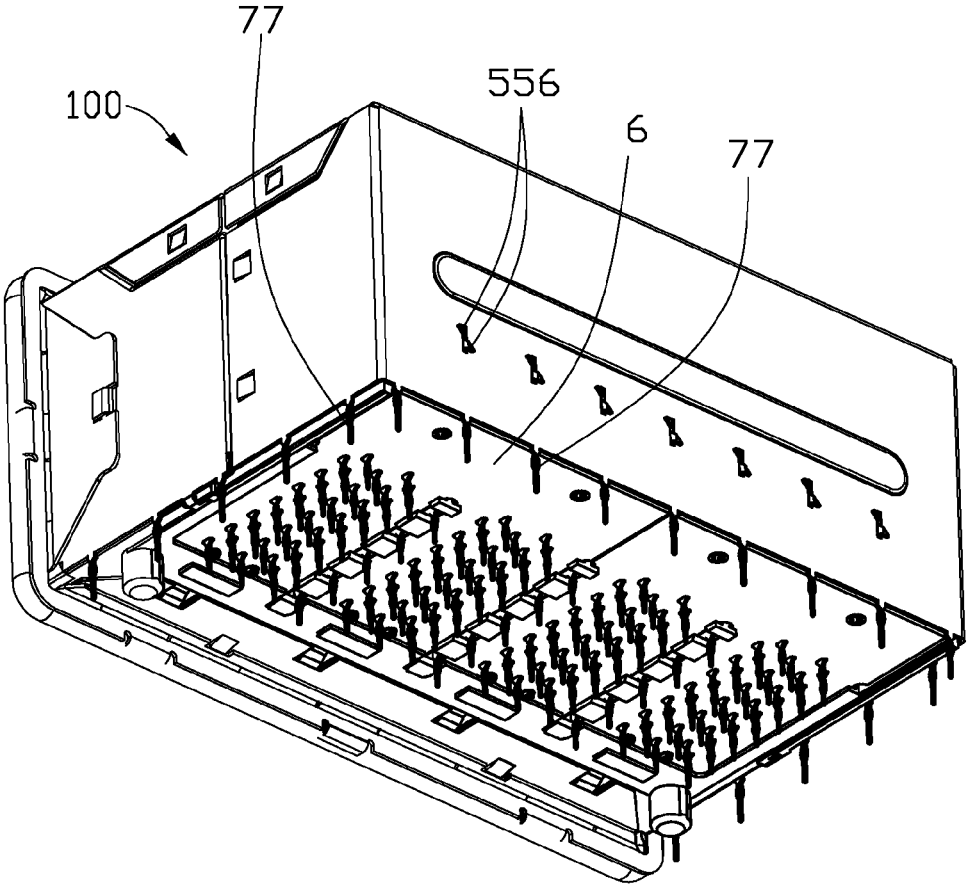
FIG. 4 is another perspective view of the electrical connector shown in FIG. 1.

Reference will now be made in detail to the preferred embodiment of the present invention.

Referring to FIGS. 1-4, a 2×4-port electrical connector 100 (modular jack) according to the present invention is shown. The electrical connector 100 is mounted on a horizontal mother PCB 101. The electrical connector 100 has a row of upper ports 102 and a row of lower ports 103 vertically stacked in columns, each of which is used to receive a modular plug (not shown) with a high speed, e.g., 10 Gigabit/second. The modular plug inserts into one port 102, 103 along an insertion direction. The electrical connector 100 includes an insulative housing 2, a plurality of vertical shielding wafers 3, four contact modules 5 assembled to the insulative housing 2, a bottom PCB 6 mounted on the contact modules 5, a conductive member 90, 91, an outer metal shielding shell 7, and a front shielding assembly 8.

Figure 5:
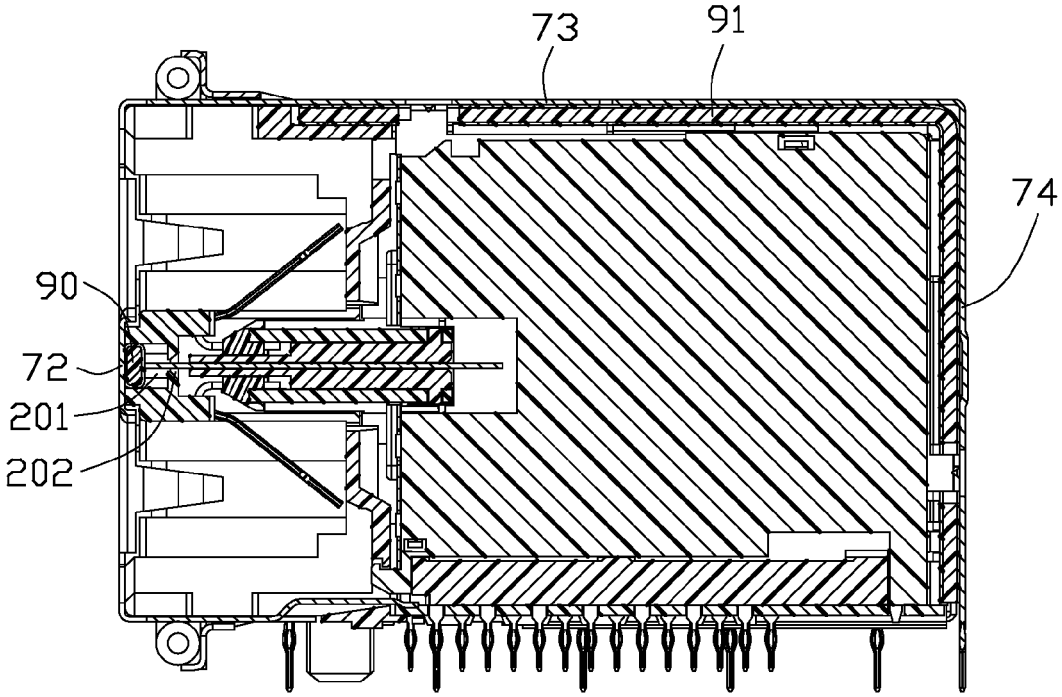
FIG. 5 is a cross-sectional view of the electrical connector shown in FIG. 1, taken along line 5-5.
Figure 6:
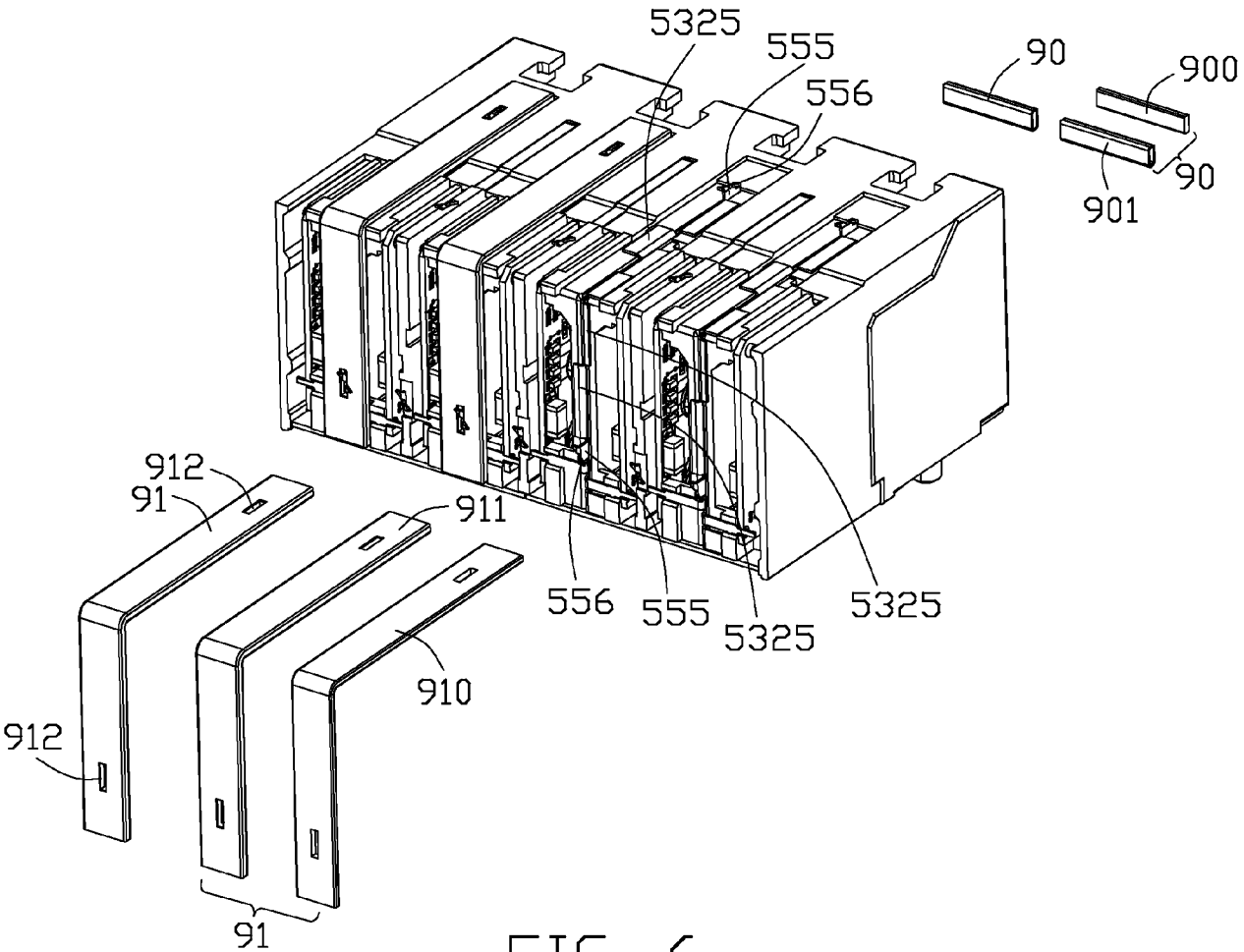
FIG. 6 is a partly exploded view of the electrical connector shown in FIG. 1, with the shielding shell removed therefrom.
Figure 7:
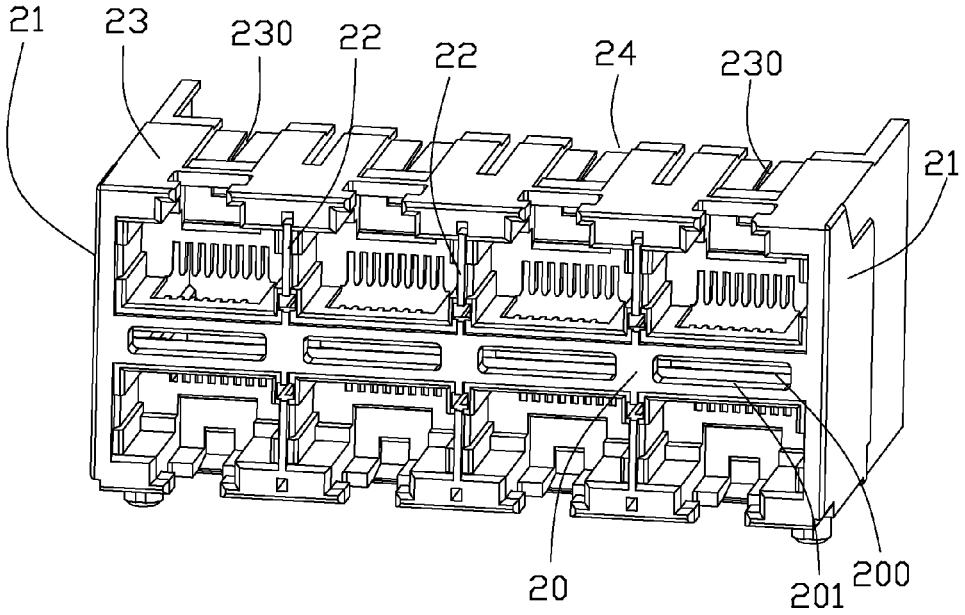
FIG. 7 is a perspective view of a housing seen in FIG. 3.

Referring to FIGS. 5-7, the insulative housing 2 has a front wall 20, two side walls 21, three vertical walls 22 located between two side walls 21, and a top wall 23. The front wall 20 defines a slot 200 located between each upper port 102 and an associated lower port 103. The slot 200 penetrates the front wall 20 and communicates with the upper and lower ports 102, 103. The slot 200 has a first slot 201 recessed into the front wall 20 along a front-to-back direction and a second slot 202 rearwardly of the first slot 201. The width of the first slot 201 along the bottom-to-top direction is greater than that of the second slot 202. The top wall 23 defines a top slot 230 above each upper port 102. The top slot 230 extends from a rear edge of the top wall 23 along a rear-to-front direction. The insulative housing 2 defines a receiving space 24 at the rear side of the insulative housing 2.

Figure 8:
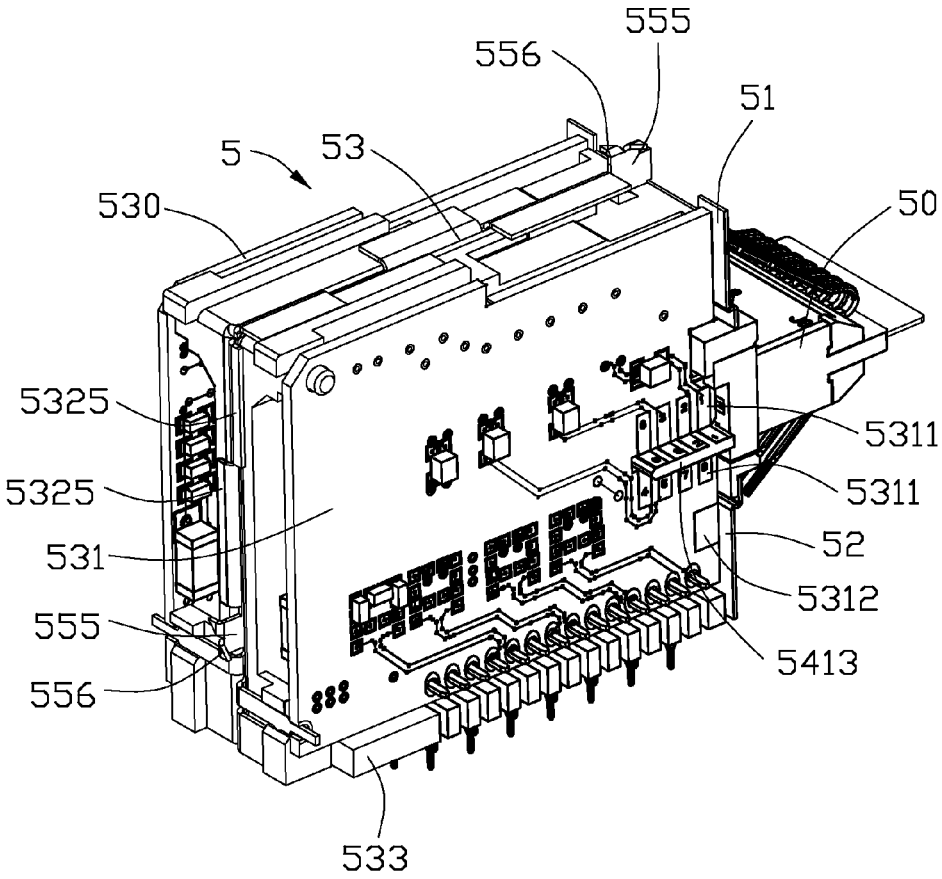
FIG. 8 is a perspective view of a contact module seen in FIG. 3.
Figure 9:
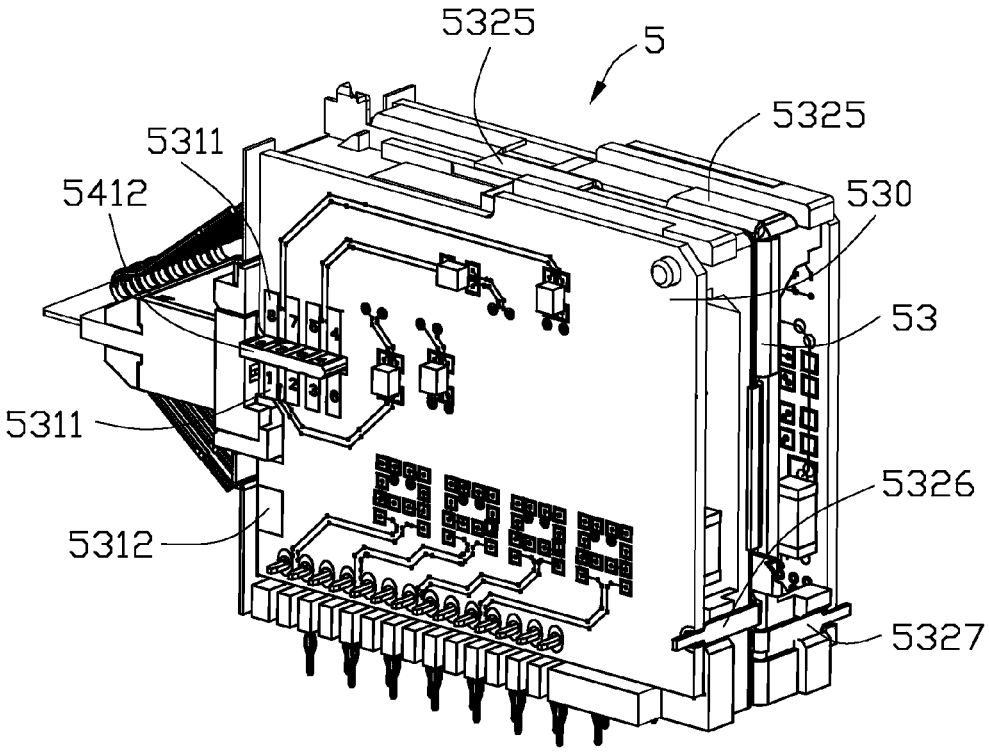
FIG. 9 is another perspective view of the contact module shown in FIG. 8.
Figure 10:
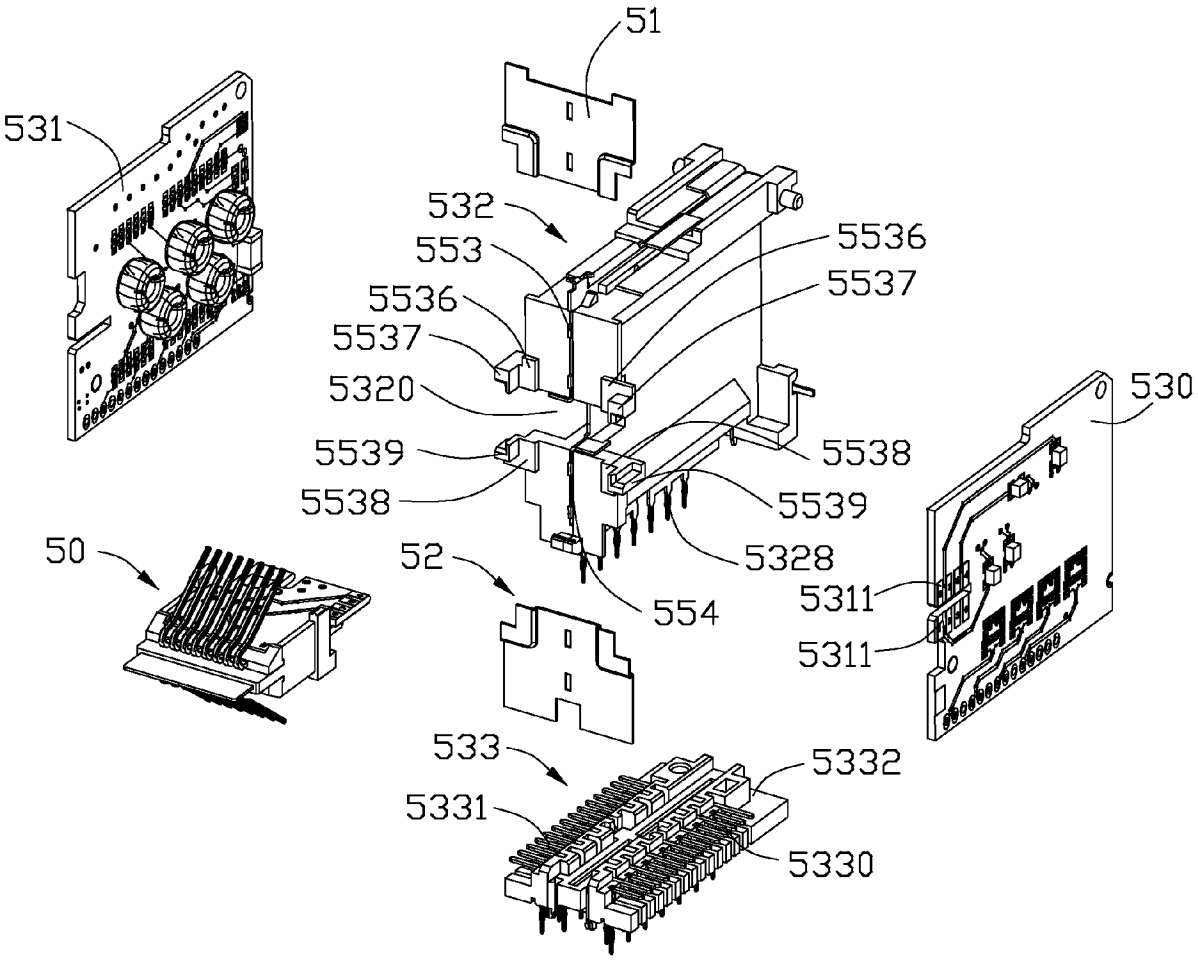
FIG. 10 is a partly exploded view of the contact module shown in FIG. 9.
Figure 11:
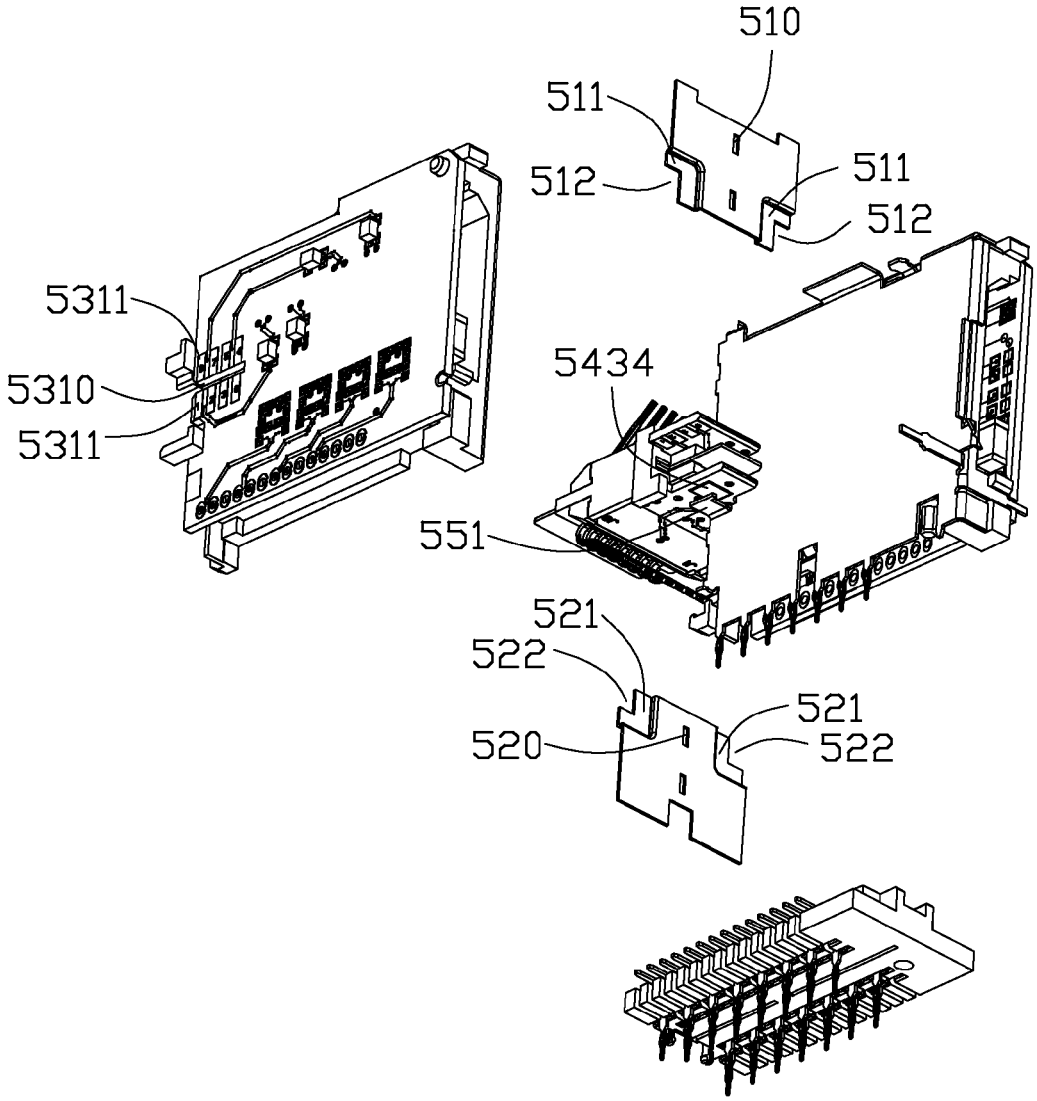
FIG. 11 is another partly exploded view of the contact module shown in FIG. 9.
Figure 12:
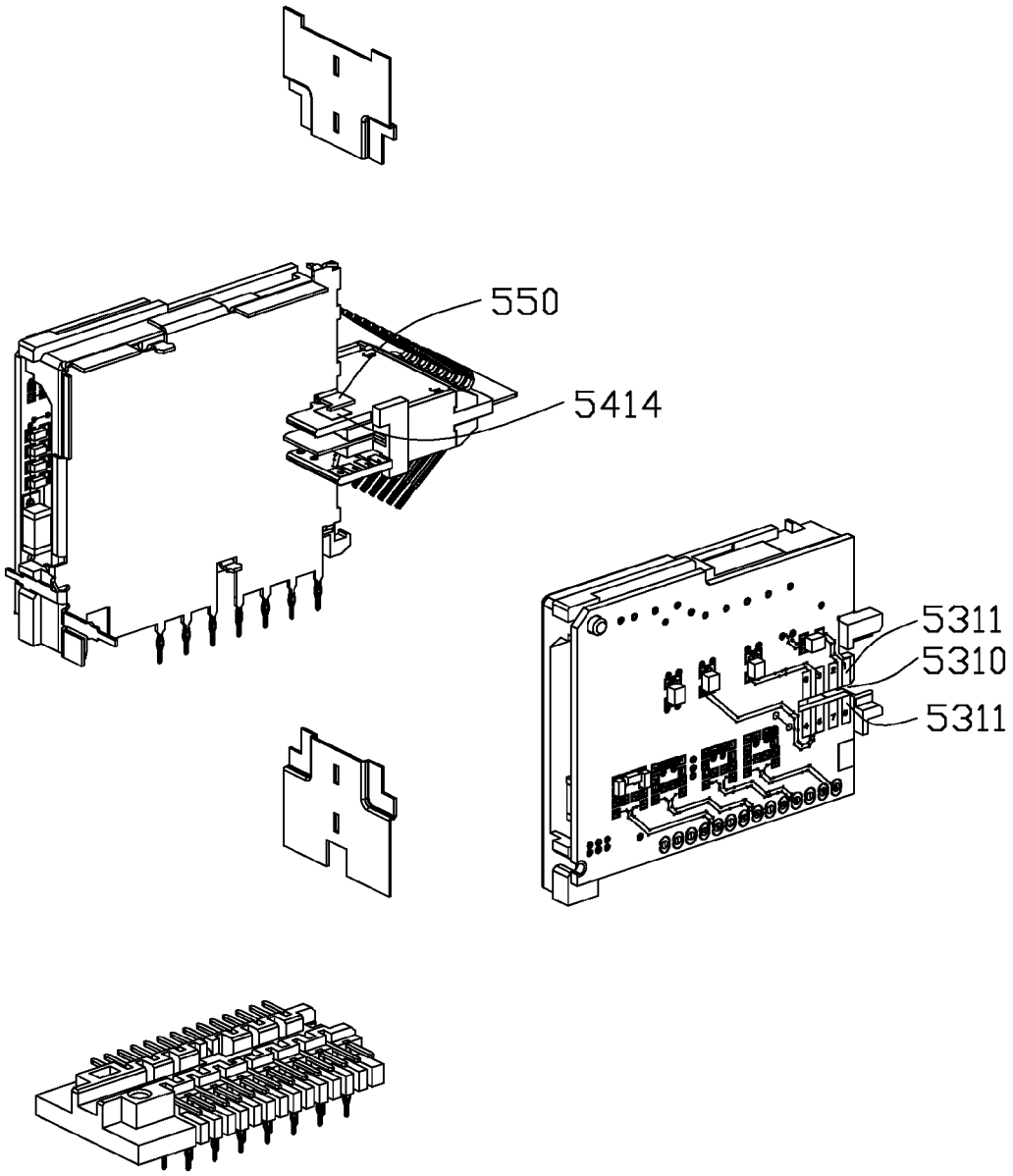
FIG. 12 is still another partly exploded view of the contact module shown in FIG. 9.
Figure 13:
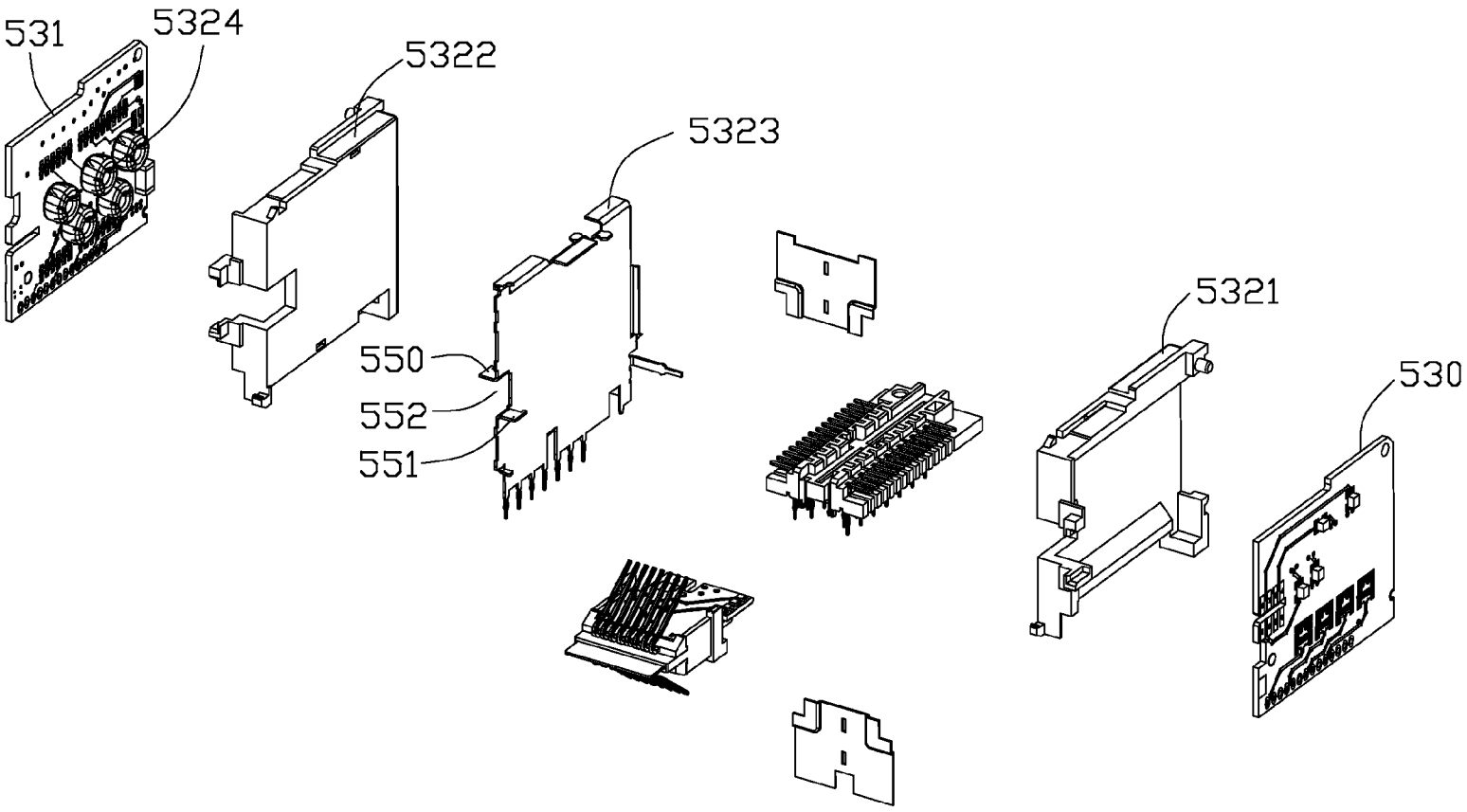
FIG. 13 is an exploded view of the contact module shown in FIG. 9.

Referring to FIGS. 8-10, each contact module 5 includes a mating module 50, an upper shielding component 51, a lower shielding component 52, and a transferring module 53 electrically connecting with the mating module 50. The transferring module 53 is located behind the mating module 50. The upper and lower shielding components 51, 52 are assembled at the front side of the transferring module 53. The mating module 50 is assembled to the transferring module 53 and at least partly disposed at the front side of the upper and lower shielding components 51, 52.

Figure 14:
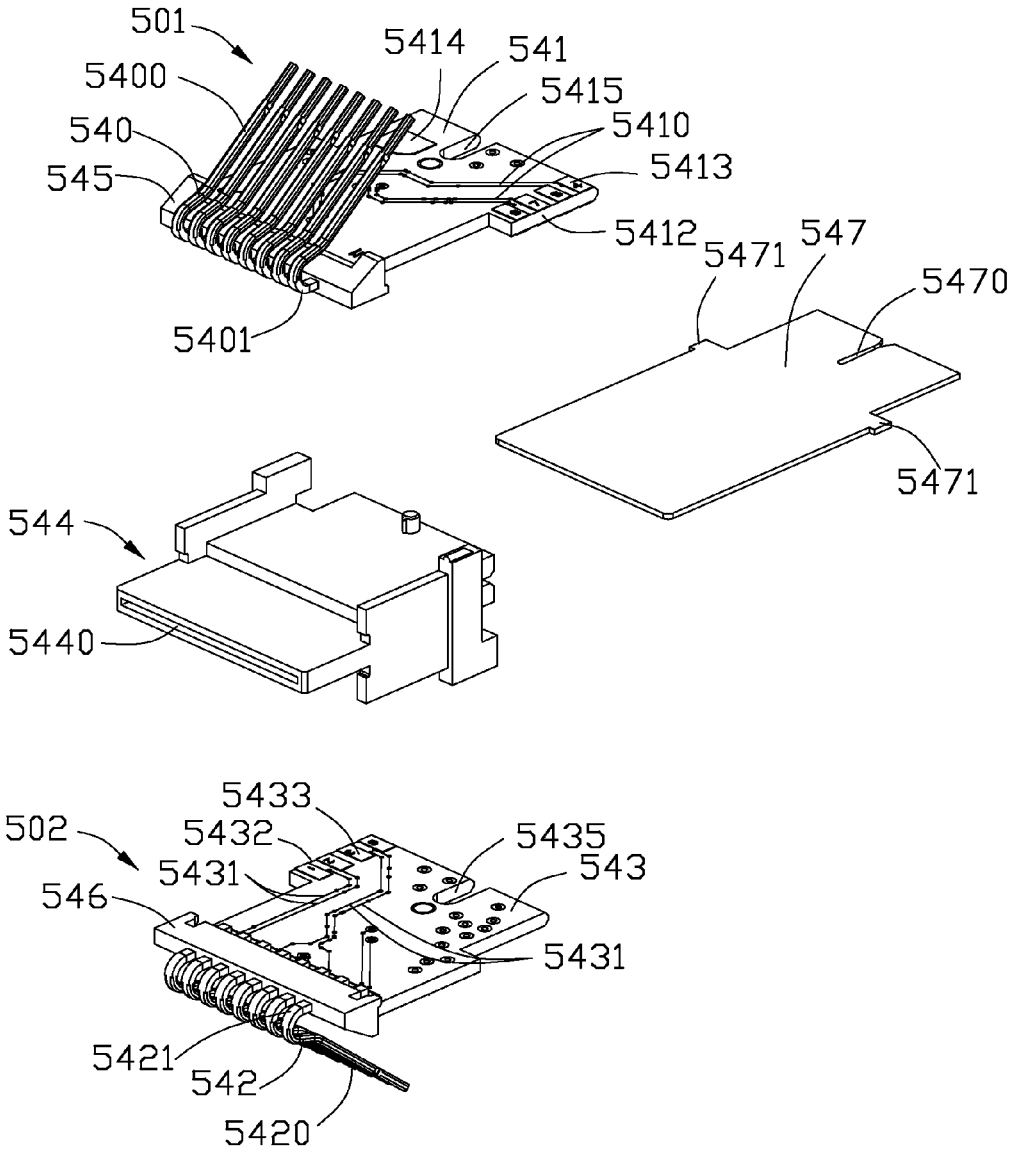
FIG. 14 is an exploded view of a mating module seen in FIG. 10.
Figure 15:
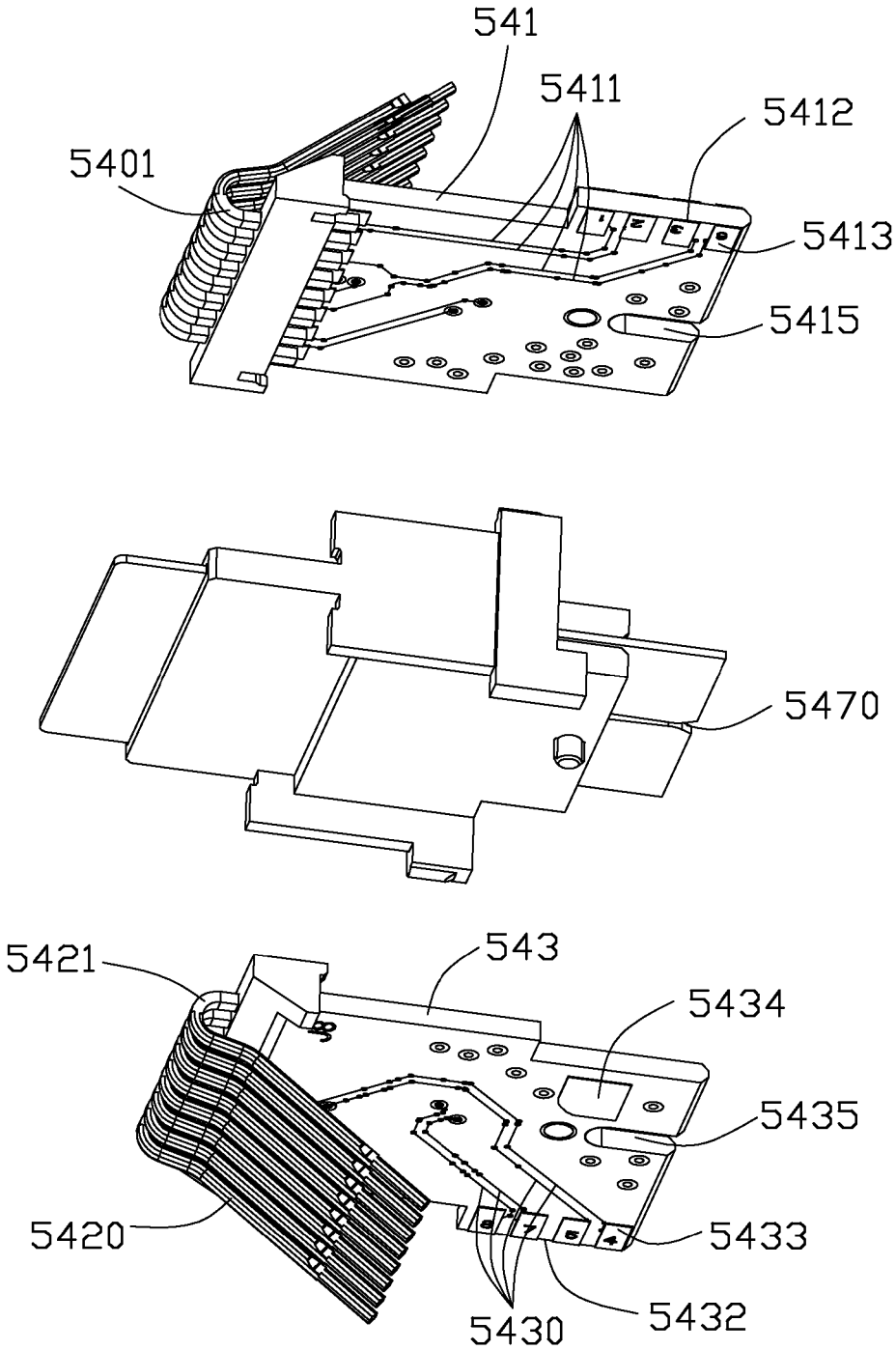
FIG. 15 is another exploded view of the mating module shown in FIG. 10.

Referring to FIGS. 14-15, the mating module 50 includes an upper mating module 501, a lower mating module 502, a plastic carrier 544 and a horizontal ground plate 547. The upper and lower mating modules 501, 502 are supported by the upper and lower side of the plastic carrier 544, respectively. The upper mating module 501 includes an upper set of contacts 540, an upper insulative body 545, and an upper PCB 541. The lower mating module 502 includes a lower set of contacts 542, a lower insulative body 546, and a lower PCB 543. The upper set of contacts 540 are insert molded with the upper insulative body 545. The upper insulative body 545 defines an upper retention recess 548 (FIG. 16) for insertion of the upper PCB 541. The upper PCB 541 electrically connects with the upper set of contacts 540. The lower set of contacts 542 are insert molded with the lower insulative body 546. The lower insulative body 546 defines a lower retention recess 549 (FIG. 17) for insertion of the lower PCB 543. The lower PCB 543 electrically connects with the lower set of contacts 542. Each of the upper and lower set of contacts 540, 542 includes four differential signal pairs.

The upper and lower PCBs 541, 543 are disposed horizontally between the upper and lower shielding components 51, 52. The plastic carrier 544 defines a middle passageway 5440 running through front and rear edges. The horizontal ground plate 547 has two block portions 5471 respectively formed at the left and right sides and a first inserting slot 5470 extending from the rear edge along a rear-to-front direction. The horizontal ground plate 547 is inserted into the middle passageway 5440 along the rear-to-front direction until the block portions 5471 engage with the plastic carrier 544. After the horizontal ground plate 547 is assembled to the plastic carrier 544, the horizontal ground plate 547 extends forward beyond the plastic carrier 544.

Figure 16:
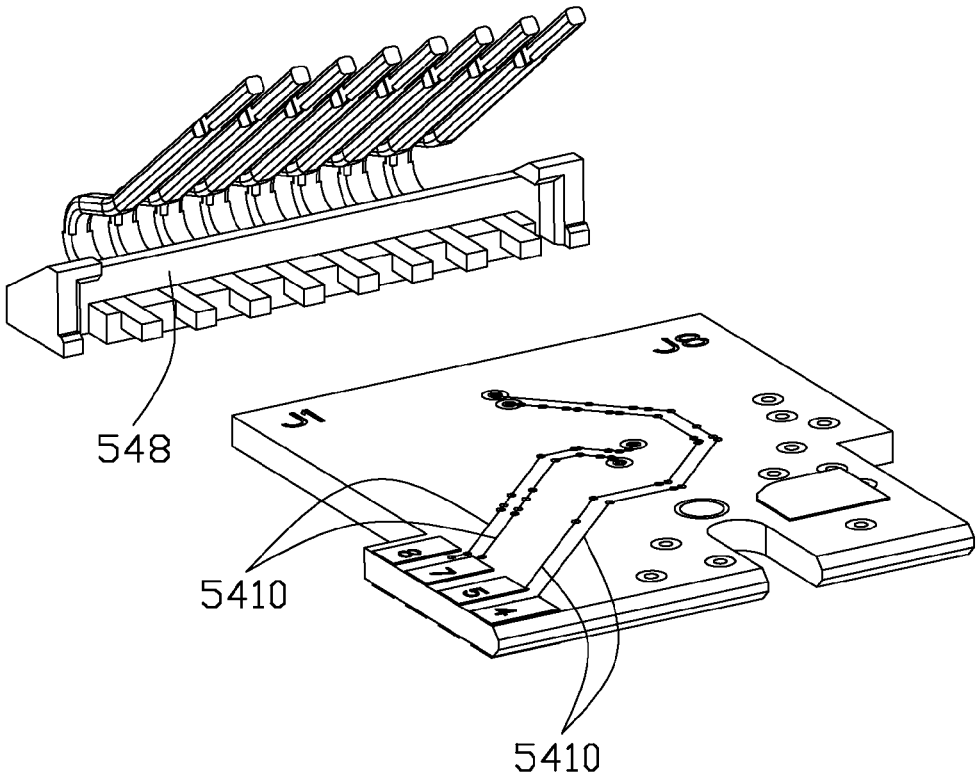
FIG. 16 is a perspective view of an upper mating module and an upper PCB seen in FIG. 14 aligned in separated positions.
Figure 17:
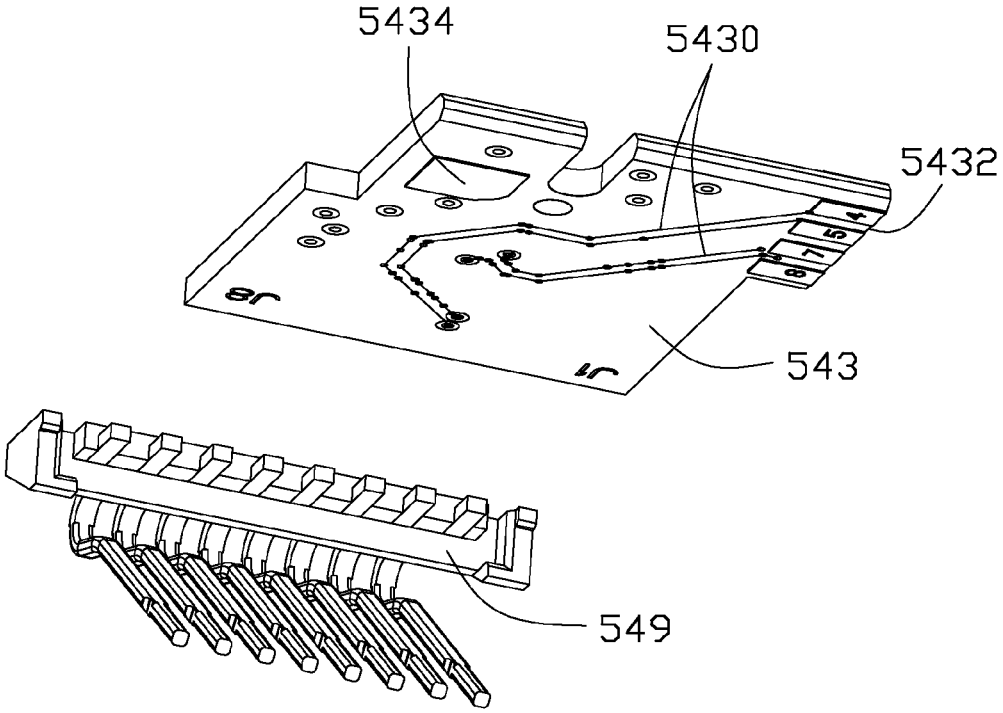
FIG. 17 is a perspective view of a lower mating module and a lower PCB seen in FIG. 14 aligned in separated positions.

Referring to FIGS. 14-16, each upper set of contacts 540 includes a contact portion 5400 and a connecting portion 5401. The connecting portion 5401 is soldered or otherwise electrically connected to the lower side of the upper PCB 541. The upper PCB 541 includes a plurality of conductive traces, an upper shielding layer, a first conducting edge 5412, an upper ground section 5414 for grounding and a second inserting slot 5415 opening at the rear edge. The conductive traces include a first conductive trace 5410 and a second conductive trace 5411 disposed at the upper and lower sides of the upper PCB 541, respectively. The first and second conductive traces 5410, 5411 electrically connect with different differential signal pairs of the upper set of contacts 540, respectively. The upper shielding layer is disposed between the first and second conductive traces 5410, 5411 for providing a shield of electromagnetic interference (EMI) and crosstalk therebetween. The upper ground section 5414 is disposed upon the upper side of the upper PCB 541. The upper shielding layer eclectically connects with the upper ground section 5414 for grounding. The first conducting edge 5412 forms two rows of conductive pads 5413 located at the upper and lower sides of the upper PCB 541 respectively to connect with the first and second conductive traces 5410, 5411.

Referring to FIGS. 14-17, each lower set of contacts 542 includes a contact portion 5420 and a connecting portion 5421. The connecting portion 5421 is soldered or electrically connects to the upper side of the lower PCB 543. The lower PCB 543 includes a plurality of conductive traces, a lower shielding layer, a second conducting edge 5432, a lower ground section 5434 for grounding, and a third inserting slot 5435 opening from the rear edge of the lower PCB 543 along the rear-to-front direction. The conductive traces include a third conductive trace 5430 and a fourth conductive trace 5431 disposed at the upper and lower sides of the lower PCB 543, respectively. The third and fourth conductive traces 5430, 5431 electrically connect with different differential signal pairs of the lower set of contacts 542, respectively. The lower shielding layer is disposed between the third and fourth conductive traces 5430, 5431 for providing a shield of EMI and crosstalk therebetween. The lower ground section 5434 is disposed upon the lower side of the lower PCB 543. The lower shielding layer connects with the lower ground section 5434 for grounding. The second conducting edge 5432 forms two rows of conductive pads 5433 located at the upper and lower sides of the lower PCB 543 respectively to connect with the third and fourth conductive traces 5430, 5431.

The horizontal shielding plate 547 positioned between the upper and lower mating modules 501, 502 could provide a shield of EMI and crosstalk therebetween.

Referring to FIGS. 8-10, the upper shielding component 51 is disposed between the upper set of contacts 540 and the transferring module 53 for providing a shield of EMI therebetwen. The lower shielding component 52 is disposed between the lower set of contacts 542 and the transferring module 53 for providing a shield of EMI therebetwen. The upper shielding component 51 is disposed above the upper PCB 541. The lower shielding component 52 is disposed below the lower PCB 543.

Referring to FIGS. 8-13, each transferring module 53 includes a left PCB 530, a right PCB 531, a center bracket 532, and a transferring contact module 533. The left and right PCBs 530, 531 are disposed vertically and extending along a front-to-rear direction. The left and right PCBs 530, 531 are separated from each other. The transferring contact module 533 is assembled at the lower side of the center bracket 532. The upper PCB 541 electrically interconnects with the upper set of contacts 540 and the left PCB 530. The lower PCB 543 electrically interconnects with the lower set of contacts 542 and the right PCB 531. The left and right PCBs 530, 531 respectively has a plurality of electronic components provided thereon. Each of the left and right PCBs 530,531 has a horizontal slot 5310 opening from the front edge along a front-to-rear direction and two rows of conductive pads 5311 positioned at the upper and lower sides of the slot 5310. The center bracket 532 includes a vertical ground plate 5323, a left plastic body 5321 and a right plastic body 5322 sandwiching the vertical ground plate 5323. The center bracket 532 defines an opening 5320 at the front edge along the front-to-rear direction. The left PCB 530 is assembled to the left plastic body 5321. The right PCB 531 is assembled to the right plastic body 5322.

Referring to FIGS. 8-13, the vertical ground plate 5323 has a substantially rectangular main plate portion. The vertical ground plate 5323 has a plurality of flanges 5325 extending outwardly at the upper and rear edges. The flanges 5325 engage with the left and right plastic body 5322 for a better retention. The vertical ground plate 5323 further has a plurality of grounding tails 5328 for connecting the horizontal mother PCB 101, a left arm 5326 eclectically connecting with the left PCB 530 and a right arm 5327 eclectically connecting with the right PCB 531. The left and right arms 5326, 5327 are inserted and soldered to the left and right PCBs 530, 531, respectively. The vertical plate 5323 forms an upper ground portion 550, a lower ground portion 551, two first extending portions 553 and two second extending portions 554 at the front edge. The first extending portions 553 are positioned above the upper ground portion 550. The second extending portions 554 are positioned below the upper grounding portion 550. The upper and lower ground portions 550, 551 extend opposite to each other and transversely from the vertical ground plate 5323. The upper and lower ground portions 550, 551 define a shielding opening 552 therebetween. The shielding opening 552 is a section of the opening 5320. The vertical ground plate 5323 is partly exposed to the opening 5320. The vertical ground plate 5323 forms a retention arm 555 extending upwardly and another retention arm 555 extending rearwardly. The retention arm 555 has two retention sections 556 reversely riveted on the shielding shell 7.

Referring to FIG. 10, the transferring contact module 533 is assembled at the lower side of the center bracket 532. The transferring contact module 533 includes a plurality of first transferring contacts 5330 connecting to the left PCB 530, a plurality of second transferring contacts 5331 connecting to the right PCB 531 and a carrier body 5332 carrying the first and second transferring contacts 5330, 5331. The first and second transferring contacts 5330, 5331 pass through the bottom PCB 6 to assemble on the horizontal mother PCB 101.

Referring to FIG. 8-11, the upper shielding component 51 defines two first holes 510 corresponding to the first extending portions 553 and two first concave portions 511 positioned at its left and right bottom corners respectively. The first holes 510 are disposed at the middle position in a horizontal direction and lined in a vertical direction. Each first concave portion 511 protrudes forwardly and has a first cutout 512 located at the corner. The center bracket 532 forms a first retention portion 5536 at the front edge and a second retention portion 5537 extending therefrom. The lower shielding component 52 defines two second holes 520 corresponding to the second extending portions 554 and two second concave portions 521 positioned respectively at its left and right bottom corners. The second holes 510 are disposed at the middle position in a horizontal direction and lined in a vertical direction. Each second concave portion 521 protrudes forwardly and has a second cutout 522 located at the corner. The center bracket 532 forms a third retention portion 5538 at the front edge and a fourth retention portion 5539 extending therefrom.

The bottom PCB 6 assembled at the lower side of the transferring module 53 has a shielding layer for providing a shield for EMI between the lower side of the transferring module 53 and an outer device. The upper and lower shielding components 51, 52 are disposed perpendicularly to the bottom PCB 6. The upper and lower shielding components 51, 52 provide a shield for EMI and crosstalk between the mating module 50 and the transferring module 53. Each of the left and right PCBs 530, 531 electrically connects with at least an upper or lower shielding component 51, 52. In the depicted embodiment, each of the left and right PCBs 530, 531 has a ground pad 5312 for soldering to the lower shielding component 52.

Referring to FIG. 1-5, the shielding shell 7 includes a front shell 70 and a rear shell 71 assembled with each other. The shielding shell 7 includes a front wall 72, a top wall 73, a rear wall 74, two side walls 75 and a plurality of ground tails 77. The shielding shell 7 has a plurality of inserting openings 76 positioned at the top and rear walls 73, 74, respectively. The top wall 73 constitutes of a top wall of the front shell 70 and a top wall of the rear shell 71 assembled with each other. Each side wall 75 constitutes of a front portion of the rear shell 71 and a rear portion of the front shell 70.

Referring to FIG. 3-6, the conductive member includes a first conductive member 90 and a second conductive member 91. Each of the first and second conductive members 90, 91 includes a conductive foam 900 and a conductive fabric 901 enclosing the conductive foam 900. The first conductive member 90 is made of an elongated strip and its width along a left-right direction is greater than that of the front edge of the horizontal ground plate 547. The second conductive 91 formed as a L-shaped strip has a horizontal portion and a vertical portion. Each of the horizontal and vertical portions defines an inserting hole 912 corresponding with the inserting opening 76.

In assembling, firstly, the left plastic body 5321, the right plastic body 5322, and the vertical ground plate 5323 are assembled as a unit. The upper and lower shielding components 51, 52 are assembled to the center bracket 532 along the front-to-rear direction. The first concave portion 511 mates with the first and second retention portions 5536, 5537. The second concave portion 521 mates with the third and fourth retention portions 5538, 5539. The first extending portion 553 is inserted into the first holes 510 and soldered to the upper shielding component 51. The second extending portion 554 is inserted into the second holes 520 and soldered to the lower shielding component 52.

Secondly, the mating module 50 is assembled to the opening 5320 of the center bracket 532. The vertical ground plate 5323 is partly inserted into the first, second and third inserting slots 5470, 5415, 5435. The horizontal plate 547 interference fits with the vertical shielding plate 5323. The upper ground portion 550 is then soldered to the ground section 5414 of the upper PCB 541, and the lower ground portion 551 to the ground section 5434 of the lower PCB 543.

Thirdly, the left and right PCBs 530, 531 is assembled to the center bracket 532. The first conducting edge 5412 of the upper PCB 541 is soldered to the left PCB 530. The second conducting edge 5432 of the lower PCB 543 is soldered to the right PCB 531. The ground pads 5312 of the left and right PCBs 530, 531 are soldered to the lower shielding component 52. The and lower shielding components 51, 52 are plate shaped and easily assembled to the center bracket 532. The upper and lower shielding components 51, 52 extend over the left and right PCBs 530, 531 along a left-to-right direction for full shielding.

Fourthly, the vertical shielding wafers 3 are inserted into the insulative housing 2. The bottom PCB 6 is assembled onto the bottom side of the contact module 5 for forming an insert module 4. The insert module 4 is assembled into the receiving space 24 of the housing 2. The upper set of contacts 540 are received in the upper port 102 respectively. The lower set of contacts 542 are received in the lower port 103 respectively. The front section of the horizontal ground plate 547 is inserted from the second slot 202 into the first slot 201. The first conductive member 90 is inserted into the first slot 201 and positioned to the vertical ground plate 5323. The second conductive member 91 is assembled to the insert module 4 and the insulative housing 2. The retention arm 555 is inserted through the inserting hole 912.

Fifthly, the front shell 70 is assembled to the insulative housing 2. The first conductive member 90 is positioned between the front section of the horizontal ground plate 547 and the front wall 72 of the shielding shell 7. The rear shell 71 is assembled to the front shell 70 and the insulative housing 2. The retention arm 555 is inserted through the inserting opening 76 to the outer side of the shielding shell 7. The retention sections 556 of the retention arm 555 are riveted on the shielding shell 7 and extending toward two opposite directions. The horizontal section of the second conductive member 91 is resisted between the top edge of the second conductive member 91 and the top wall 73. The vertical portion of the second conductive member 91 is resisted between the rear edge of the vertical ground plate 91 and the rear wall 74. The front shielding assembly 8 is assembled to the front side of the shielding shell 7.

The first conductive member 90 is disposed between the front wall 72 and the front edge of the horizontal ground plate 547 for filling the gap therebetween. The horizontal portion of the second conductive member 91 is disposed between the top wall 73 and the top edge of the vertical ground 5323 plate for filling the gap therebetween. The vertical portion of the second conductive member 91 is disposed between the rear wall 74 and the rear edge of the vertical ground plate 5323 for filling the gap therebetween. The first and second conductive members 90, 91 could fill the gaps for shielding EMI leaking therefrom. Therefore, the electrical connector 100 could provide a good shield and electrical performance.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. An electrical connector comprising:

a port for insertion of a mating connector along an insertion direction;

a mating module having a horizontal printed circuit board and a set of contacts, each of the set of contacts having a contact portion exposed in the port and a connecting portion mounted upon a surface of the printed circuit board;

a transferring module located behind the mating module and having a plurality of magnetic core mounted thereon; and a shielding component disposed between the contact portions and the transferring module; wherein the shielding component is disposed near to the horizontal printed circuit board.

2. The electrical connector as claimed in claim 1, said shielding component is of a plate shape and is perpendicular to the insertion direction.

3. The electrical connector as claimed in claim 1, said shielding component extends over the transferring module along a left-to-right direction.

4. The electrical connector as claimed in claim 3, further comprising a vertical ground plate, and wherein said transferring module comprises a first vertical printed circuit board (PCB) and a second vertical PCB on two opposite sides of the vertical ground plate, said port comprising a first port and a second port below the first port, the set of contacts comprising a first set of contacts and a second set of contacts received in the first and second ports, respectively, the first and second vertical PCBs having a plurality of conductive components formed thereon and electrically connecting with the first and second set of contacts, respectively.

5. The electrical connector as claimed in claim 4, wherein said transferring module comprises a center bracket having a left plastic body and a right plastic body sandwiching the vertical ground plate, the first vertical PCB assembled to the first plastic body, the second vertical PCB assembled to the second plastic body, each of the first and second plastic bodies having a retention portion for positioning the shielding component.

6. The electrical connector as claimed in claim 5, wherein said shielding component electrically connects with the vertical ground plate.

7. The electrical connector as claimed in claim 6, wherein said shielding component has a hole, the vertical ground plate having an extending portion inserted to the hole.

8. The electrical connector as claimed in claim 7, wherein said shielding component comprises a first shielding component and a second component below the first component, each of the first and second vertical PCBs having a ground pad formed thereon electrically connecting with a corresponding one of the first and second shielding components.

9. The electrical connector as claimed in claim 8, wherein said mating module comprises a first horizontal PCB and a second horizontal PCB below the first horizontal PCB, the first and second horizontal PCBs electrically connecting the first and second set of contacts to the first vertical and second vertical PCBs, respectively, the first shielding component located above the first horizontal PCB, the second shielding component located below the second horizontal PCB.

10. An electrical connector comprising:

an insulative housing defining a mating port;

a mating module including an insulator unifying a plurality of terminals with front contacting sections exposed in the mating port, and rear mounting sections secured to a horizontal printed circuit board;

a transferring module located behind the mating module and having a vertical printed circuit board extending along a front-to-back direction and equipped with a plurality of conductive components mounted thereon; and a vertical shielding plate applied upon a front face of the transferring module and perpendicular to said front-to-back direction; wherein the horizontal printed circuit board extends rearwardly beyond the vertical shielding plate.

11. The electrical connector as claimed in claim 10, wherein the vertical printed circuit board defines a horizontal slot through which a rear region of the horizontal printed circuit board transversely protrudes outwardly.

12. The electrical connector as claimed in claim 10, further including another vertical shielding plate in the transferring module along the front-to-back direction with means intersecting said vertical shielding plate.

13. The electrical connector as claimed in claim 12, wherein the horizontal printed circuit board is mechanically and electrically connected to said another vertical shielding plate.

14. The electrical connector as claimed in claim 12, wherein the transferring module includes a pair of plastic bodies sandwiching said another vertical shielding plate therebetween in a transverse direction perpendicular to said front-to-back direction.

15. The electrical connector as claimed in claim 14, further including another vertical printed circuit board cooperating with said vertical printed circuit board to commonly sandwich said pair of plastic bodies therebetween in said transverse direction.

16. The electrical connector as claimed in claim 10, wherein the mating module includes an insulator to which the horizontal printed circuit board is mounted.

17. The electrical connector as claimed in claim 16, wherein a horizontal shielding plate is received in the insulator.

18. The electrical connector as claimed in claim 17, further including another vertical shielding plate in the transferring module along the front-to-back direction with means intersecting said vertical shielding plate and said horizontal shielding plate.

19. An electrical connector comprising:

a port for insertion of a mating connector along an insertion direction;

a mating module having a set of contacts received in the port, each of the set of contacts having a contact portion for mating with the mating connector;

a transferring module located behind the mating module and having a plurality of conductive components mounted thereon; and a shielding component disposed between the contact portions and the transferring module;

said shielding component extends over the transferring module along a left-to-right direction;

further comprising a vertical ground plate, and wherein said transferring module comprises a first vertical printed circuit board (PCB) and a second vertical PCB on two opposite sides of the vertical ground plate, said port comprising a first port and a second port below the first port, the set of contacts comprising a first set of contacts and a second set of contacts received in the first and second ports, respectively, the first and second vertical PCBs having a plurality of conductive components formed thereon and electrically connecting with the first and second set of contacts, respectively; wherein said transferring module comprises a center bracket having a left plastic body and a right plastic body sandwiching the vertical ground plate, the first vertical PCB assembled to the first plastic body, the second vertical PCB assembled to the second plastic body, each of the first and second plastic bodies having a retention portion for positioning the shielding component.

20. The electrical connector as claimed in claim 19, wherein said shielding component electrically connects with the vertical ground plate.

* * * * *